US008507046B2

(12) United States Patent
Agari et al.

(10) Patent No.: US 8,507,046 B2
(45) Date of Patent: Aug. 13, 2013

(54) METHOD OF CREATING A FLUID LAYER IN THE SUBMICROMETER RANGE

(75) Inventors: Michaela Agari, Heidelberg (DE); Bernard Beier, Ladenburg (DE); Gerald Erik Hauptmann, Bammental (DE); Gerd Junghans, Schwetzingen (DE); Ralf Kissel, Herxheim am Berg (DE); Andreas Rupprecht, Mauer (DE); Joachim Sonnenschein, Mühltal (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 150 days.

(21) Appl. No.: 13/074,365

(22) Filed: Mar. 29, 2011

(65) Prior Publication Data

US 2011/0244143 A1 Oct. 6, 2011

(30) Foreign Application Priority Data

Mar. 29, 2010 (DE) ..... 10 2010 013 249

(51) Int. Cl.
*B05D 1/28* (2006.01)
*B05C 1/08* (2006.01)

(52) U.S. Cl.
USPC ..... 427/428.01; 427/428.08; 427/428.12; 427/428.15; 118/255

(58) Field of Classification Search
USPC ..... 427/428.01, 428.02, 428.12, 428.15; 118/255
See application file for complete search history.

(56) References Cited

U.S. PATENT DOCUMENTS

| | | | | |
|---|---|---|---|---|
| 4,046,931 | A * | 9/1977 | Innes et al. | 427/428.09 |
| 5,633,045 | A * | 5/1997 | Smith et al. | 427/428.17 |
| 5,779,795 | A | 7/1998 | Bucher et al. | |
| 2003/0232126 | A1 * | 12/2003 | Yang | 427/58 |
| 2008/0134916 | A1 | 6/2008 | Luckhardt et al. | |
| 2011/0041713 | A1 | 2/2011 | Haakmann et al. | |

FOREIGN PATENT DOCUMENTS

| | | | |
|---|---|---|---|
| DE | 19948311 | A1 | 4/2001 |
| DE | 69616560 | T2 | 9/2002 |
| DE | 102007053489 | A1 | 6/2008 |
| DE | 102007062940 | A1 | 6/2009 |
| EP | 0842457 | B1 | 10/2001 |

OTHER PUBLICATIONS

L. Vitos et al. "The Surface Energy of Metals" Surface Science 411 (1998) 186-202.*
German Search Report dated Sep. 6, 2010.

* cited by examiner

*Primary Examiner* — Nathan Empie
(74) *Attorney, Agent, or Firm* — Laurence A. Greenberg; Werner H. Stemer; Ralph E. Locher

(57) ABSTRACT

A method of creating a fluid layer in the micrometer range includes transferring a fluid between substrates and forming a fluid layer. A surface energy of a first substrate releasing the fluid is higher than a surface energy of a fluid on the first substrate to create a first fluid deposit on the first substrate. A surface energy of a second substrate accepting the fluid is lower than a surface energy of a fluid on the second substrate to create a second fluid deposit on the second substrate that is reduced as compared to the first fluid deposit. A surface energy of a third substrate accepting the fluid is higher than a surface energy of a fluid on the third substrate to create a substantially homogeneous third fluid deposit on the third substrate that forms the fluid layer.

11 Claims, 1 Drawing Sheet

STEP A
D1
F
FD1
FS1
P1'
P1
S1

STEP B
D2
F
FD2
FS2
P2'
P2
S2
S4

STEP C
D3
F
FD3
FS3
P3'
P3
S3
S5

METHOD OF CREATING A FLUID LAYER IN THE SUBMICROMETER RANGE

CROSS-REFERENCE TO RELATED APPLICATION

This application claims the priority, under 35 U.S.C. §119, of German Patent Application DE 10 2010 013 249.7, filed Mar. 29, 2010; the prior application is herewith incorporated by reference in its entirety.

BACKGROUND OF THE INVENTION

Field of the Invention

The present invention relates to a method of creating a fluid layer in the submicrometer range, in which a fluid is transferred between substrates and a fluid layer is formed.

Printing presses that have printing units, inking units, and inking unit rollers which convey and meter printing ink are known from the prior art. Due to the ink splitting effect between two rollers, the thickness of an ink layer on successive rollers can be gradually reduced. However, the ink splitting can only create ink layer thicknesses in the micrometer range. Such an ink layer thickness is sufficient for the production of printed products such as books, magazines, posters and the like. In the field of so-called "printed electronics," however, there is an increasing demand to be able to create fluid layers of less than one micrometer in thickness.

The decisive factors in terms of the capability of a roller surface of being wetted by a fluid such as printing ink are the respective surface energies of the roller surface and of the fluid. A high surface energy of the roller surface and a low surface energy of the fluid result in good wetting properties. Another crucial factor in terms of the transfer of the fluid to a downstream roller is the surface energy of the downstream roller. If the surface energy of the downstream roller is higher than that of the upstream roller, the fluid with the low surface energy will be well transferred.

Published German Patent Application DE 199 48 311 A1 describes a method of improving print quality in which at least in some transfer locations, the surface energies of those surfaces that contact the ink on its way from the ink fountain to the material to be printed are adjusted in such a way that the transfer of the ink from one surface to the next along the ink transport path is enhanced. Thus it is desirable for the surface energies of ink-conveying rollers that succeed each other in the direction of ink transport to increase and never to decrease. For example, parts that are adjacent each other during operation may have a respective coating.

Published German Patent Application DE 10 2007 053 489 A1, corresponding to U.S. Patent Application Publication No. US 2008/0134916 A1, describes a printing press including a washing device for the inking unit. The document suggests to place a roller that has a high surface energy between two phobic rollers that have a low surface energy and to engage a cleaning blade with the former. The central roller of the aforementioned three rollers is thus constructed in such a way that ink will accumulate thereon to be scraped off.

German Translation DE 696 16 560 T2 of European Patent EP 0 842 457 B1, corresponding to U.S. Pat. No. 5,779,795, describes a porous PTFE film on the outer surface of a roller for metering and applying a fluid. The film has a low surface energy and thus good de-wetting properties, i.e. it easily releases the fluid.

The documents cited above do not include any information on how to use the described technologies to create fluid layers in the submicrometer range rather than in the micrometer range.

SUMMARY OF THE INVENTION

It is accordingly an object of the invention to provide a method of creating a fluid layer in the submicrometer range, which overcomes the hereinafore-mentioned disadvantages of the heretofore-known methods of this general type.

With the foregoing and other objects in view there is provided, in accordance with the invention, a method of creating a fluid layer in the submicrometer range, wherein a fluid is transferred between substrates and a fluid layer is formed. The method comprises the steps of:

- providing a fluid-releasing first substrate having a surface energy that is higher than the surface energy of the fluid on the first substrate to create a first fluid deposit on the first substrate;
- providing a fluid-accepting second substrate having a surface energy that is lower than the surface energy of the fluid on the second substrate to create a second fluid deposit on the second substrate, the second fluid deposit being reduced as compared to the first fluid deposit; and
- providing a fluid-accepting third substrate having a surface energy that is higher than the surface energy of the fluid on the third substrate to create a substantially homogeneous third fluid deposit on the third substrate, the third fluid deposit forming the fluid layer.

When the method of the invention is carried out, an initially thick fluid layer FS1 (of more than 1 μm in thickness) is transformed into a thinner yet inhomogeneous fluid layer FS2, which is then transformed into a very thin and homogeneous fluid layer FS3 (of less than 1 μm in thickness). In accordance with the invention, the desired very thin and homogeneous fluid layer FS3 is obtained unexpectedly by way of a thin yet inhomogeneous fluid layer FS2. In other words, the homogeneity of the layer is temporarily given up to then create fluid layers of less than 1 micrometer in thickness.

In accordance with a preferred further development of the invention which is advantageous due to the high degree of process stability that can be obtained, the method may comprise the steps of:

- selecting the surface energies of the fluid on the substrates in such a way that they are substantially identical,
- controlling the thickness of the fluid layer substantially by making relative adjustments to the surface energies of the substrates by ensuring that:
- to create a fluid barrier, the surface energy of the second substrate which accepts the fluid is lower than the surface energy of the first substrate which releases the fluid, and
- that the surface energy of the third substrate which accepts the fluid is higher than the surface energy of the second substrate which releases the fluid.

An alternative and thus likewise preferred further development of the method of the invention may comprise the steps of:

- providing substrates that have substantially identical surface energies; and
- controlling the fluid layer thickness substantially by relatively adjusting the surface energies of the fluid on the substrates by ensuring that:
- to create a fluid barrier, the surface energy of the fluid on the second substrate is higher than the surface energy of the fluid on the first substrate, and that the surface energy of the fluid on the third substrate is lower than the surface energy of the fluid on the second substrate.

In accordance with a preferred further development of the method of the invention which is advantageous in terms of the simplicity of the process and the number of components provided for the purpose, may comprise the step of conveying the fluid F from the first substrate to the third substrate exclusively by way of the second substrate.

In accordance with another preferred further development of the method of the invention which may at first seem counterintuitive but turns out to be of particular advantage in terms of the creation of very thin layers, may comprise the step of creating a fluid deposit that forms a non-continuous and inhomogeneous second fluid layer on the second substrate.

In accordance with an advantageous and thus preferred further development of the method of the invention, the third layer may be provided to have a thickness selected from one of the following thickness ranges of between approximately 10 nm and approximately 1 μm, between approximately 10 nm and approximately 500 nm, and between approximately 10 nm and approximately 100 nm.

In accordance with a preferred further development of the method of the invention which is advantageous in terms of obtaining the thinnest layers in the submicrometer range, the fluid may be transferred from the second substrate to the third substrate through at least one further pair of substrates having at least one further fluid barrier.

In accordance with an advantageous and thus preferred further development of the method of the invention, the third fluid layer may be transferred from the third substrate substantially completely and permanently to a printing material.

In accordance with an advantageous and thus preferred further development of the method of the invention, the relative adjustment of the surface energies of the substrates may be made by using one of the following methods:

- using different materials for at least two substrates,
- using different material mixes for at least two substrates,
- using different nanoparticles for at least two substrates,
- using different adsorbates for at least two substrates,
- varying the temperature of at least two substrates,
- varying the electric potential on at least two substrates,
- treating at least two substrates with electromagnetic radiation,
- treating at least two substrates with particle radiation.

In accordance with an alternative and thus preferred further development of the method of the invention, the relative adjustment of the surface energies of the fluid on the substrates may be made by using at least one of the following methods:

- varying the solvent content of the fluid,
- varying the temperature of the fluid,
- varying the pH value of the fluid,
- adding at least one reactive chemical substance changing its surface energy to the fluid,
- adding at least one non-reactive chemical substance changing its surface energy to the fluid.

Other features which are considered as characteristic for the invention are set forth in the appended claims.

Although the invention is illustrated and described herein as embodied in a method of creating a fluid layer in the submicrometer range, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DETAILED DESCRIPTION OF THE INVENTION

Figures 1A, 1B, 1C:
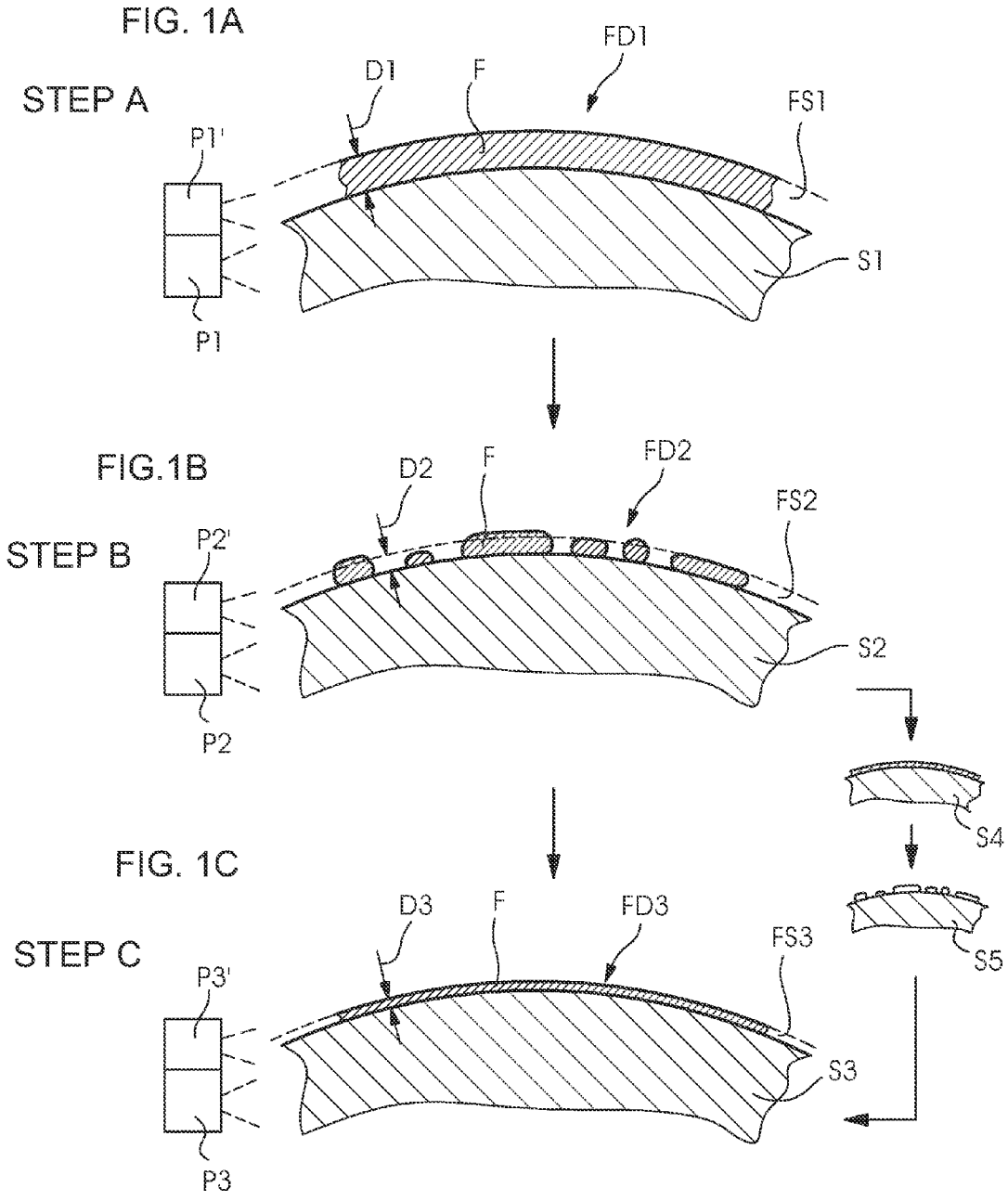
FIGS. 1A, 1B and 1C are fragmentary, diagrammatic, cross-sectional views showing a fluid being transferred between substrates in a preferred exemplary embodiment of a method according to the invention.

Referring now in detail to FIGS. 1A, 1B and 1C of the drawing as a whole, in which the invention and further developments that are advantageous in terms of construction and/or function are described in more detail based on at least one preferred exemplary embodiment and in which corresponding elements are identified by identical reference numerals, there is seen a preferred embodiment of the method according to the invention of creating and metering a fluid layer in the micrometer range. A fluid F is transferred between substrates S1, S2 and S3 and a fluid layer FS3 is formed. An important aspect of the creation of a fluid layer in the submicrometer range in accordance with the invention is a specific control of the respective surface energies of the substrates that are involved in the transfer and/or of the fluid. As a consequence, the prevailing forces of cohesion and adhesion can be adjusted in a targeted way, thus controlling the amount of fluid that is transferred. Another important aspect is an at least localized separation of two process steps of i) reducing the amount of fluid that is transferred and ii) smoothing the transferred amount of fluid.

A preferred application of the method of the invention is the creation of very thin layers of a fluid, i.e. layers of fluid in the submicrometer range, in a process of printing technology, i.e. in the frame of a printing process and/or in a (lithographic offset) printing press. In the context of the invention, the term "submicrometer range" refers to a range of between approximately 10 nanometers and approximately 1 micrometer, preferably of between approximately 10 nanometers and approximately 500 nanometers, in particular preferably between approximately 10 nanometers and approximately 100 nanometers. Such very thin layers are necessary to create printed electronics, for instance.

The first aspect of the invention to be described in more detail herein is the fluid. The fluid may be a conventional printing ink or a conventional printing varnish. However, a preferred type of fluid to be used in the context of the invention is a so-called functional fluid. This means that as the fluid layer in the submicrometer range, the fluid has a specific function on the final substrate. This function may, for example, be electric conductivity, i.e. the fluid layer may be created in a structured way so as to form paths of electrical conductors or circuits.

As far as the substrates are concerned, at least three substrates are used in accordance with the invention. All three substrates are preferably shaped as cylindrical surfaces such as jackets of rotating rollers or cylinders. The materials used for the respective surfaces are preferably hard materials such as metal and soft materials such as rubber-like materials provided in alternating fashion. The fluid is transferred from the last substrate, on which the fluid layer in the submicrometer range is created, to a moving printing material such as paper, board, a (plastic) film, or a (metal) plate. Another possibility is that the last substrate, on which the fluid layer in the submicrometer range is created, is already the printing material. If the substrates are roller surfaces, they need to have very low roughness values to form the layers in the submicrometer range. In addition, they ought to have low wear and high surface quality and need high degrees of chemical and thermal durability.

In the following text, three steps which are important to the invention will be described in greater detail. In a first step A (creating a first deposit, seen in FIG. 1A), a first fluid deposit FD1 is created on a first substrate S1. The first substrate S1 is preferably a cylindrical jacket surface of a roller in a printing unit. The first fluid deposit FD1 is preferably created by the application of a fluid, for example by an upstream roller or a spray coating unit. Alternatively, the first deposit may be created by a fluid emerging from pores in the surface of the first substrate S1, for example by supplying the fluid to the interior of the roller.

The first fluid deposit FD1 preferably forms a substantially continuous, substantially homogeneous fluid layer FS1, i.e. a fluid layer FS1 of a substantially constant thickness D1. This fluid layer FS1 has a thickness D1 that is greater than a desired thickness D3 (for example >1 μm) which is likewise substantially constant, of the final fluid layer FS3 in the submicrometer range that is to be created. Thus, in accordance with the invention, the fluid layer of the first fluid deposit FD1 will be reduced in at least one further step.

The respective surface energies γ of the substrate S1 and/or of the fluid F on the substrate S1 are preferably adjusted by respectively using respective process units P1 and P1'. The unit P1 may, for instance, be a temperature control device, a device for molecular coating, or a device for creating an electrical potential, or a plasma, UV, laser, or electron radiation device. The unit P1' may, for instance, be a device for adding or removing a solvent, for adding reactive or non-reactive chemical substances, a temperature control device, or a device for modifying the pH value.

In a second process step B (creation of a second deposit, seen in FIG. 1B), a second fluid deposit FD2 is created on a second substrate S2. The second substrate S2 is likewise constructed as a cylindrical jacket surface of a roller in a printing unit. In addition, the substrate S2 and the substrate S1 interact in such a way that the fluid F is partially transferred from the substrate S1 to the substrate S2. This means that it is not the entire amount of fluid F that is transferred but only a defined portion of less than approximately 50%, for example, or even less than approximately 10%.

The second fluid deposit FD2 forms a reduced fluid layer FS2, as compared to the first fluid layer FS1, for example a fluid layer of a reduced thickness D2<D1. Since the aim is to create very thin layers in the submicrometer range, it may happen that the fluid layer of the second fluid deposit FD2 is not continuous and may have gaps at irregular intervals. In addition, the second fluid layer may be inhomogeneous and may thus vary in thickness (as shown, for example, in FIG. 1B, which illustrates that the thickness D2 of the fluid layer FS2 may vary locally due to the inhomogeneity so that D2 is to be understood as an average). Thus, in accordance with the invention, the fluid layer of the second fluid deposit FD2 will additionally be smoothened in at least one further process step to close the gaps and to remove inhomogenities.

The respective surface energies γ of the substrate S and/or of the fluid F on the substrate S2 is preferably adjusted by using respective process units P2 and P2', in a manner described above with reference to process step A.

In a third process step C (homogenization, seen in FIG. 1C) a substantially homogeneous third fluid deposit FD3 is created on a substrate S3 to create the fluid layer FS3. The third substrate S3 is preferably likewise constructed as a cylindrical jacket surface of a roller in a printing unit. Moreover, the substrate S3 likewise interacts with the substrate S2 in such a way that the fluid F is at least partially transferred from the substrate S2 to the substrate S3.

The third fluid deposit FD3 preferably forms a reduced fluid layer FS3. In this case the fluid layer FS3 has a reduced thickness D3 as compared to the thickness D2 of the fluid layer FS2 (D3<D2). In addition, the fluid layer FS3 is continuous and homogeneous in contrast to fluid layer FS2.

The three-step method of the invention thus leads from a thick fluid layer FS1 to a continuous, homogeneous, very thin fluid layer FS3 through an intermediate state. The intermediate state is the fluid layer FS2, which is thinner than the fluid layer FS1 but may be non-continuous and inhomogeneous. Although these properties are undesirable in the context of the creation of a continuous, homogeneous, very thin fluid layer FS3, this intermediate state has surprisingly turned out to be advantageous because, by creating the fluid layer FS2, which may, in a manner of speaking, act as an auxiliary layer, it is possible to achieve the desired layer thickness reduction in an advantageous way with simple measures and yet with the required degree of precision and reproducibility.

The respective surface energies γ of the substrate S3 and/or of the fluid F on the substrate S3 are preferably likewise adjusted by respectively using respective process units P3 and P3', in a manner corresponding to that described above with reference to process step A.

The third fluid layer FS3 that is created in accordance with the invention preferably has a thickness D3 in one of the following thickness ranges: between approximately 10 nm and approximately 1 μm, between approximately 10 nm and approximately 500 nm, and between approximately 10 nm and approximately 100 nm.

The following paragraph will explain in more detail how the thicknesses of the layers are reduced as described above. In this context it is important to understand that the second fluid layer FS2 and the second fluid deposit FD2, respectively, on the second substrate S2 acts as a barrier for conveying the fluid precisely because of otherwise undesirable properties, such as non-continuity and inhomogenity. In accordance with the invention, this barrier function may additionally be controlled in a specific, targeted way. In this manner, it is advantageously possible to adjust the amount of fluid F that is conveyed per unit of time and thus to vary the thickness D3 of the third fluid layer FS3 even if the thickness D1 of the first fluid layer FS1 remains constant.

For this purpose, in accordance with the invention, the surface energies of the three substrates S1, S2, and S3 and the respective surface energies of the fluid F on the three substrates S1, S2, and S3 are controlled and adjusted to have a defined relationship.

At this point, it should be pointed out that the fluid F remains substantially unchanged while being conveyed. This means, in particular, that its functional properties such as the electric conductivity do not change. However, the surface energy of the fluid F may be modified along the conveying path so that the surface energy of the fluid F on an upstream substrate may be higher or lower than the surface energy of the same fluid on a downstream substrate.

The relationships between the surface energies which are important to the invention are as follows: i) the surface energy γS1 of the first substrate S1 releasing the first Fluid F is higher than the surface energy γF1 of the fluid F on the first substrate S1, ii) the surface energy γS2 of the second substrate S2 accepting the fluid F is lower than the surface energy γF2 of the fluid F on the second substrate S2, and iii) the surface energy γS3 of the third substrate S3 accepting the fluid F is higher than the surface energy γF3 of the fluid F on the third substrate S3.

Feature i) allows the creation of the first fluid deposit FD1 on the first substrate S1 because in this case the fluid F wets substantially the entire surface of the first substrate S1. In other words, the first substrate S1 exhibits good wetting properties for the fluid F.

Feature ii) then allows the creation of the second fluid deposit FD2, which is on the second substrate S2 and is reduced as compared to the first fluid deposit FD1. The reduction of the amount of fluid is caused by the fact that the fluid F only wets the surface of the second substrate S2 to a limited extent. There may even be the formation of drop-like fluid accumulations, as if the surface was to a certain extent fluid-repellent, in a manner of speaking. In any case only a small proportion of the fluid F is transferred between the two substrates S1 and S2. This is why the present description refers to a "barrier." In order to get from substrate S1 to substrate S3, the fluid must follow its conveying path through substrate S2. As compared to the substrates S1 and S3, however, the substrate S2 has a lower wetting capacity in terms of the fluid F.

In accordance with a preferred further development, the fluid F is conveyed from the substrate S1 to the substrate S3 exclusively through the barrier of the substrate S2, i.e. there are no parallel conveying paths. In conventional roller-type inking units, there is generally a plurality of rollers which allow the printing ink to pass through a number of parallel paths through the roller-type inking unit. In the context of the present invention, however, the fluid must preferably pass the second substrate S2 on its way from the first substrate S1 to the third substrate S3. This means that there is no parallel path of fluid transport and all of the fluid F must pass the at least one fluid barrier. Alternatively, it would be possible to provide parallel fluid transport paths with respective fluid barriers.

Finally, feature iii) allows the creation of the third fluid deposit FD3, which is on the third substrate, forms the fluid layer FS3 and is substantially homogeneous. The wetting property of the fluid F in terms of the substrate S3 is comparable to feature i). This means that the fluid F wets the entire surface of the third substrate S3, thus causing a reduction of the thickness D3 of the fluid layer FS3.

Adjusting the surface energy relationships as described above can be achieved in two alternative ways: Either I) the surface energy of the fluid F is kept substantially constant, i.e. the surface energies γF1, γF2 and γF3 are substantially identical, and the surface energies γS1, γS2 and γS3 of the substrates S1 S2, and S3 are adjusted to be different. Or, alternatively II), the other way around, i.e. the surface energies γS1, γS2, γS3 of the substrates S1, S2 and S3 are substantially identical and the surface energies γF1, γF2, γF2 of the fluid are adjusted to be different. A third alternative would be to adjust both the surface energies γF1, γF2 and γF3 of the fluid and the surface energies γS1, γS2, γS3 of the substrates to be different from each other. The preferred alternative is to adjust the substrate surface energies γS1, γS2, γS3 to different values, with surface energies γS1 and γS3 being potentially identical.

Alternative I) (constant surface energy of the fluid) thus presents itself as follows: the surface energies γF1, γF2, γF3 of the fluid F on the substrates S1, S2 and S3 are substantially identical. The thickness D3 of the fluid layer FS3 is substantially controlled by relatively adjusting the surface energies γS1, γS2 and γS3 of the substrates S1, S2, S3 so that the surface energy γS2 of the second substrate S2, which accepts the fluid F, is lower than the surface energy γS1 of the first substrate S1, which releases the fluid F, and so that the surface energy γS3 of the third substrate S3, which accepts the fluid F, is higher than the surface energy γS2 of the second substrate S2, which releases the fluid F.

In this manner, a very small amount of fluid F is transferred in a first step because the second substrate 32 tends to accept the fluid F only to a limited extent. Then, in a second step, the very small amount of fluid F that has been transferred is smoothened or evened out on the surface of the third substrate S3 because the third substrate S3 tends to accept substantially the entire reduced amount of fluid F and thus to distribute the fluid F substantially evenly across the surface of the third substrate S3.

In this context, the surface energies γS1, γS2 and γS3 of the substrates S1, S2 and S3 are preferably adjusted relative to each other before the fluid transfer is carried out, preferably in accordance with one of the following methods:

I.1) using different materials for at least two substrates S1, S2 and S3, with the materials having different surface energies, I.2) using different material mixes for at least two substrates S1, S2 and S3, I.3) using different nanoparticles for at least two substrates S1, S2 and S3, preferably with a basic material of low surface energy being used (for one substrate) and, for example, nanoparticles of an additive material having a high surface energy being integrated at least in a region close to the surface (for a different substrate), or vice versa, I.4) using different adsorbates for at least two substrates S1, S2 and S3, preferably amphiphilic molecules as a nanoscopic molecular surface coating of different coverage density (modification of the coverage density preferably through the use of different solvents and/or solvent concentrations, different exposure times, or subsequent irradiation), I.5) varying the temperature of at least two substrates S1, S2 and S3, I.6) varying the electric potential on at least two substrates S1, S2 and S3, I.7) treating at least two substrates S1, S2 and S3 with electromagnetic radiation, preferably UV radiation or laser radiation, I.8) treating at least two substrates S1, S2 and S3 with particle radiation, preferably through the use of plasma or electron beams.

For reasons of increased process security, alternative I is preferred over alternative II, which will be described in more detail below. The adjustment of the surface energies of the substrates prior to the transfer of the fluid in particular grants a higher degree of process security than an adjustment of the surface energy of the fluid on the substrates during the transfer of the fluid.

Alternative II) (constant surface energy of the substrates) thus presents itself as follows: the surface energies γS1, γS2, γS3 of the substrates S1, S2 and S3 are substantially identical, and the thickness D3 of the fluid layer FS3 is substantially controlled by a relative adjustment of the surface energies γF1, γF2, γF3 of the fluid F on the substrates S1, S3, S3 in such a way that the surface energy γF2 of the fluid F on the second substrate S2 is higher than the surface energy γF1 of the fluid on the first substrate S1 and the surface energy γF3 of the fluid F on the third substrate 33 is lower than the surface energy γF2 of the fluid F on the second substrate S2.

This alternative likewise ensures that a very small amount of fluid F is transferred in a first step because the fluid F on the second substrate S2 tends to wet the surface of the substrate S2 only to a limited extent. Subsequently, in a second step, the very small amount of the fluid F that has been transferred is smoothened on the surface of the third substrate S3, because the reduced amount of fluid F on the third substrate S3 tends to wet substantially the entire surface of the substrate S3 and thus to distribute evenly across the surface of the third substrate S3.

A relative adjustment of the surface energies γF1, γF2, γF3 of the fluid F on the substrates S1, S2 and S3 is preferably made while the fluid transfer is being carried out and preferably using one of the following methods:

II.1) varying the solvent content of the fluid F, preferably by adding a solvent to the fluid F through the use of a nozzle or an additional roller and/or by removing solvent by the influence of heat, for example microwave radiation, II.2) varying the temperature of the fluid F, preferably using a temperature-controlled stream of gas, electromagnetic radiation, or a vaporization unit, II.3) varying the pH value of the fluid F, preferably by acid-base titration or using a catalytic agent, II.4) adding to the fluid F at least one reactive chemical substance that changes the surface energy, with "reactive" meaning that the substance undergoes a chemical reaction with at least one component of the fluid F, modifying the surface energy of the fluid F as a result, and II.5) adding to the fluid F at least one non-reactive chemical substance that changes the surface energy, with "non-reactive" meaning that for example amphiphilic molecules such as surfactants are added.

In order to reduce the thickness D3 of the fluid layer FS3 even further, it is possible to include iterative intermediate steps: fluid F may be transferred to the third substrate S3 through at least one further pair of substrates S4 and S5 with at least one further fluid barrier. In other words: the succession of process steps of the invention may be considered as an iterative method of creating ever thinner layers FS3.

The invention claimed is:

1. A method of creating a fluid layer in the submicrometer range by transferring a fluid between substrates and forming a fluid layer, the method comprising the following steps:

providing a first substrate as a roller having a surface energy being higher than a surface energy of the fluid on the first substrate to form a fluid layer of a first fluid deposit on the first substrate;

providing a second substrate as a roller;

transferring a portion of the fluid from the fluid layer on the first substrate to the second substrate, the second substrate having a surface energy being lower than a surface energy of the fluid on the second substrate to create a second fluid deposit on the second substrate, the second fluid deposit being reduced as compared to an amount of the first fluid deposit; and providing a third substrate, as a roller or as a printing material, for accepting the fluid from the second substrate, the third substrate having a surface energy being higher than a surface energy of the fluid on the third substrate to create a substantially homogeneous third fluid deposit on the third substrate, the third fluid deposit forming the fluid layer.

2. The method according to claim 1, which further comprises:

setting the surface energies of the fluid on the substrates to be substantially identical; and controlling a thickness of the fluid layer substantially by relatively adjusting the surface energies of the substrates by:

selecting the surface energy of the second substrate accepting the fluid to be lower than the surface energy of the first substrate releasing the fluid in order to form a fluid barrier, and selecting the surface energy of the third substrate accepting the fluid to be higher than the surface energy of the second substrate releasing the fluid.

3. The method according to claim 2, which further comprises achieving the relative adjustment of the surface energies of the substrates by using at least one of the following methods:

using different materials for at least two substrates, using different material mixes for at least two substrates, using different nanoparticles for at least two substrates, using different adsorbates for at least two substrates, varying a temperature of at least two substrates, varying an electric potential of at least two substrates, treating at least two substrates with electromagnetic radiation, or treating at least two substrates with particle radiation.

4. The method according to claim 1, which further comprises:

setting the surface energies of the substrates to be substantially identical; and controlling a thickness of the fluid layer substantially by relatively adjusting the surface energies of the fluid on the substrates by:

selecting the surface energy of the fluid on the second substrate to be higher than the surface energy of the fluid on the first substrate in order to form a fluid barrier, and selecting the surface energy of the fluid on the third substrate to be lower than the surface energy of the fluid on the second substrate.

5. The method according to claim 4, which further comprises achieving the relative adjustment of the surface energies of the fluid on the substrates by using at least one of the following methods:

varying a solvent content of the fluid, varying a temperature of the fluid, varying a pH value of the fluid, adding to the fluid at least one reactive chemical substance changing its surface energy, or adding to the fluid at least one non-reactive chemical substance changing its surface energy.

6. The method according to claim 1, which further comprises conveying the fluid from the first substrate to the third substrate exclusively through the second substrate.

7. The method according to claim 1, which further comprises forming a non-continuous and inhomogeneous second fluid layer with the second fluid deposit on the second substrate.

8. The method according to claim 1, which further comprises creating the third fluid layer to have a thickness belonging to one of the following thickness ranges:

between approximately 10 nm and approximately 1 μm, between approximately 10 nm and approximately 500 nm, or between approximately 10 nm and approximately 100 nm.

9. The method according to claim 1, which further comprises transferring the fluid from the second substrate to the third substrate through at least one further pair of substrates with at least one fluid barrier.

10. The method according to claim 1, which further comprises:

providing the third substrate as a roller.

11. The method according to claim 10, which further comprises transferring the third fluid layer substantially completely and permanently from the third substrate to a printing material.

* * * * *